US005845559A

United States Patent [19]

Schroeder et al.

[11] Patent Number: 5,845,559

[45] Date of Patent: Dec. 8, 1998

[54] AXIAL PISTON PUMP NEUTRAL CENTERING MECHANISM

[75] Inventors: Kevin D. Schroeder, Minneapolis; Maynard W. Marts, Bloomington, both of Minn.

[73] Assignee: Eaton Corporation, Cleveland, Ohio

[21] Appl. No.: 907,664

[22] Filed: Aug. 8, 1997

[51] Int. Cl.[6] ..... F01B 3/00

[52] U.S. Cl. ..... 92/12.2; 92/57; 92/71; 417/222.1; 417/269

[58] Field of Search ..... 92/12.2, 57, 71; 417/222.1, 269; 60/487; 74/60; 91/497

[56] References Cited

U.S. PATENT DOCUMENTS

| | | | |
|---|---|---|---|
| 3,282,225 | 11/1966 | Moon | 103/162 |
| 3,831,497 | 8/1974 | Trabbic et al. | 91/497 X |
| 3,967,541 | 7/1976 | Born et al. | 92/12.2 |
| 4,087,970 | 5/1978 | Slazas et al. | 60/487 |
| 4,111,062 | 9/1978 | Callaghan | 74/96 |
| 4,455,920 | 6/1984 | Shaw et al. | 92/12.2 |
| 4,584,926 | 4/1986 | Beck, Jr. et al. | 417/222.1 X |
| 4,934,252 | 6/1990 | Giere | 91/497 |

*Primary Examiner*—Hoang Nguyen
*Attorney, Agent, or Firm*—L. J. Kasper

[57] ABSTRACT

A variable displacement axial piston pump (11) having a tiltable swashplate (33) to vary pump displacement by a manual input lever (43). The pump includes a neutral centering device (45) in which a cam member (57) is fixed to the end of one trunnion member (35). The cam member (57) defines three cam surfaces (65), each having a minimum displacement portion (67) and at least one maximum displacement portion (69). In engagement with each of the cam surfaces (65) is a follower element (79) supported by a cam follower holder (73), both of which are biased by a set of Belleville washers (75), toward the cam member (57). The present invention provides a neutral centering device which is balanced and simple to assemble, not requiring any special fixtures or holders for preloading a biasing spring, but which is able to provide a substantially constant return torque.

9 Claims, 5 Drawing Sheets

AXIAL PISTON PUMP NEUTRAL CENTERING MECHANISM

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to variable displacement hydraulic pumps having a rotating group and a tiltable swashplate for varying the displacement of the rotating group, and more particularly, to a neutral centering mechanism for such pumps.

Although the hydraulic pump for use with the present invention may include various types of rotating groups, it is especially advantageous when used with a rotating group of the "axial piston" type, i.e., one which includes a rotating cylinder barrel defining a plurality of cylinders, and a piston reciprocable within each cylinder. Therefore, the present invention will be described in connection with such an axial piston pump.

Among the types of axial piston pumps known to those skilled in the art is one in which the tiltable swashplate includes a pair of transversely opposed trunnions which are rotatably supported, relative to the pump housing, by suitable bearing means. A pump of the type described is sometimes referred to as a "trunnion pump."

Although the present invention may also be used in pumps of the "swash and cradle" type, as illustrated and described in U.S. Pat. No. 5,590,579, assigned to the assignee of the present invention, the invention would be better suited for use in the pumps of the trunnion type, and will be described in connection therewith.

Changes in displacement of an axial piston pump (by changing the tilt angle of the swashplate) may be accomplished either by an appropriate servo mechanism or by a manual input. Typically, if displacement changes are accomplished by a servo mechanism, the servo mechanism itself typically includes an appropriate centering device, i.e., a device which biases the pump displacement toward zero, in the absence of some sort of input displacement command. The neutral centering mechanism of the present invention may be used advantageously with a servo controlled pump because, typically, there are limitations in the return torque within the servo mechanism.

However, in the case of a pump which has its displacement varied manually, it is generally recognized as being essential to provide some sort of neutral centering mechanism which will insure absolute neutral of the swashplate (and absolute zero flow from the pump) whenever the manual input member is at or very near its neutral position.

Various neutral centering devices have been designed by those skilled in the art. Unfortunately, many of the prior art neutral centering devices have been either complicated and expensive, or difficult to assemble, or have provided insufficient biasing force toward neutral, whenever operating near neutral.

For example, the neutral centering device of the type illustrated and described in U.S. Pat. Nos. 4,584,926 and 5,207,144 would both appear likely to achieve neutral in a satisfactory manner. However, the ability of the designs of the cited patents to achieve neutral is very tolerance-dependent, and requires the addition of a number of parts which must be located within the pumping chamber, surrounding the rotating group.

BRIEF SUMMARY OF THE INVENTION

Accordingly, it is an object of the present invention to provide an improved neutral centering device, which is especially suited for use on pumps of the "trunnion" type, and which overcomes the disadvantages of the prior art devices.

It is a more specific object of the present invention to provide an improved neutral centering device of the type which does not require the addition of any parts within the pumping chamber, but instead, may be operably associated with one of the swashplate trunnions.

It is a further object of the present invention to provide an improved neutral centering device which accomplishes the above-stated objects without adding substantially to the load imposed on the trunnion bearings.

It is a related object of the present invention to provide an improved neutral centering device which accomplishes all of the above-stated objects, but does not require any special, complicated assembly tools or fixtures, especially in connection with the preloading of biasing springs.

The above and other objects of the invention are accomplished by the provision of a variable displacement pump assembly of the type comprising a pump housing defining a pumping chamber, a rotating group disposed in the pumping chamber, and a tiltable swashplate operably associated with the rotating group to vary the fluid displacement thereof The swashplate defines a tilt axis and includes a trunnion member having its axis of rotation coincident with the tilt axis, the trunnion member being rotatably supported relative to the pump housing. A neutral centering mechanism is operably associated with the pump housing and with the swashplate.

The improved variable displacement pump is characterized by the neutral centering mechanism comprising a cam member having an axis of rotation, and being fixed to rotate with the trunnion member. The axis of rotation of the cam member is coincident with the axis of rotation of the trunnion member. The cam member defines a cam surface oriented generally parallel to the axis of rotation of the cam member, the cam surface including a minimum displacement portion and a maximum displacement portion. The neutral centering mechanism further includes a cam follower assembly fixed relative to the pump housing, and including a cam follower element and means biasing the cam follower element into engagement with the cam surface, whereby, when the cam follower element is in engagement with the maximum displacement portion of the cam surface, the biasing means and the cam follower element bias the cam member toward a neutral position. In this neutral position, the cam follower element is in engagement with the minimum displacement portion of the cam surface.

DETAILED DESCRIPTION OF THE PREFERRED EMBODIMENT

Figure 1:
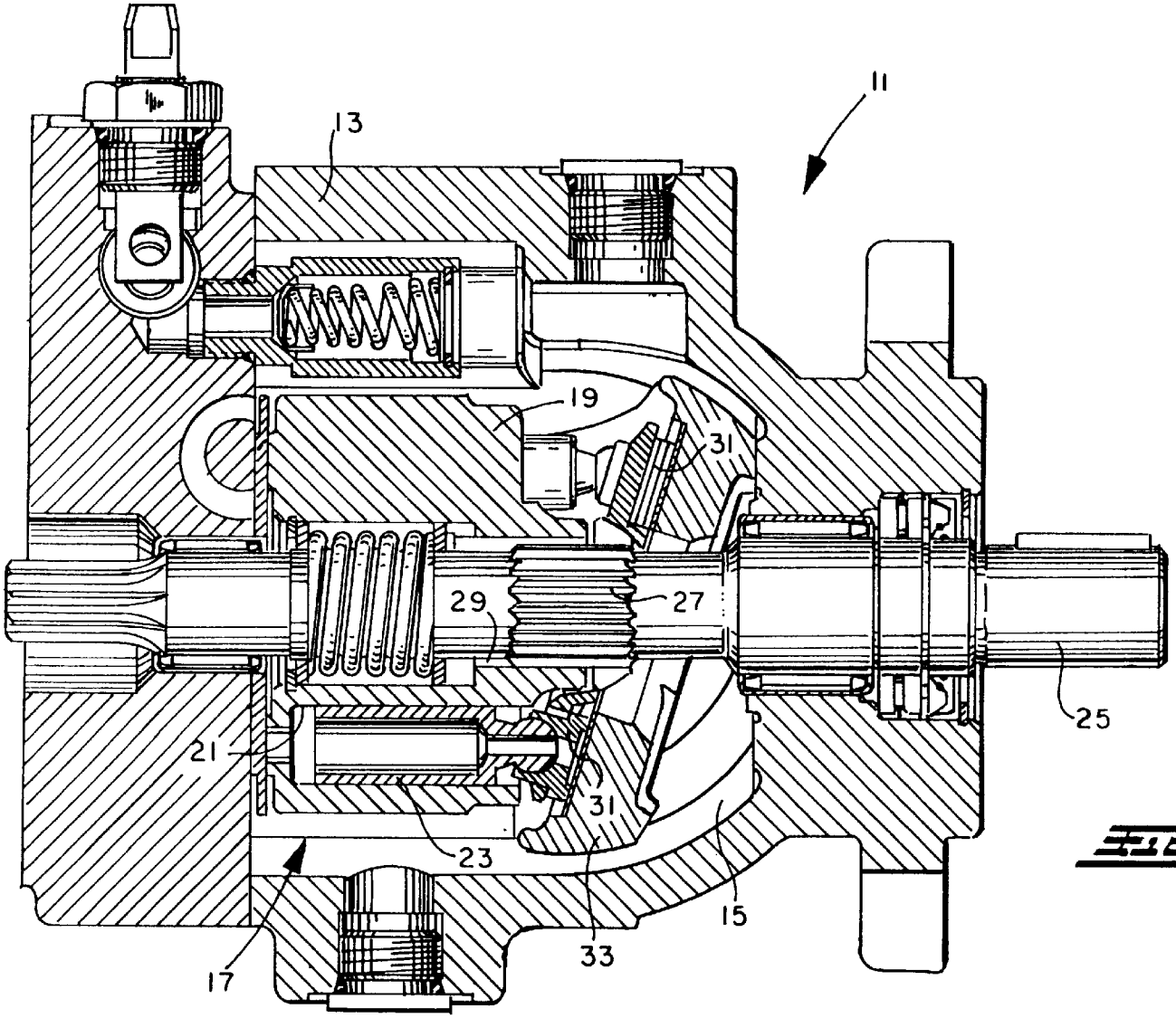
FIG. 1 is an axial cross-section of an axial piston pump of the type with which the present invention may be utilized.

Referring now to the drawings, which are not intended to limit the invention, FIG. 1 is an axial cross-section of an axial piston pump of the "trunnion" type, which is especially suited to use the neutral centering device of the present invention. The axial piston pump, generally designated 11, includes a main pump housing 13, within which is a pumping chamber 15. Disposed within the pumping chamber 15 is a rotating group (pumping element), generally designated 17. In the subject embodiment, the rotating group 17 comprises a rotatable cylinder barrel 19 defining a plurality of cylinders 21 (only one of which is shown in FIG. 1). Disposed within each cylinder 21 is a piston 23, which is reciprocable within the cylinder 21 to pump fluid therefrom in a manner well known to those skilled in the art, whenever the cylinder barrel 19 is rotating, and the pump is at some displacement other than zero.

The rotating group 17 receives input torque from an input shaft 25, which extends through substantially the entire axial length of the pump. The input shaft 25 includes a set of external splines 27, which are in engagement with a set of internal splines 29 defined by the cylinder barrel 19, such that rotation of the input shaft 25 results in rotation of the barrel 19.

Each piston 23 is seated, by means of a slipper member 31, against a transverse surface of a swashplate 33, as the cylinder barrel 19 rotates relative to the rotationally-stationary swashplate 33. Although the swashplate 33 does not rotate about the axis of rotation of the input shaft 25, it is well known to those skilled in the art that the swashplate 33 tilts or pivots about a transverse axis A1 (shown in FIG. 2).

Figure 2:
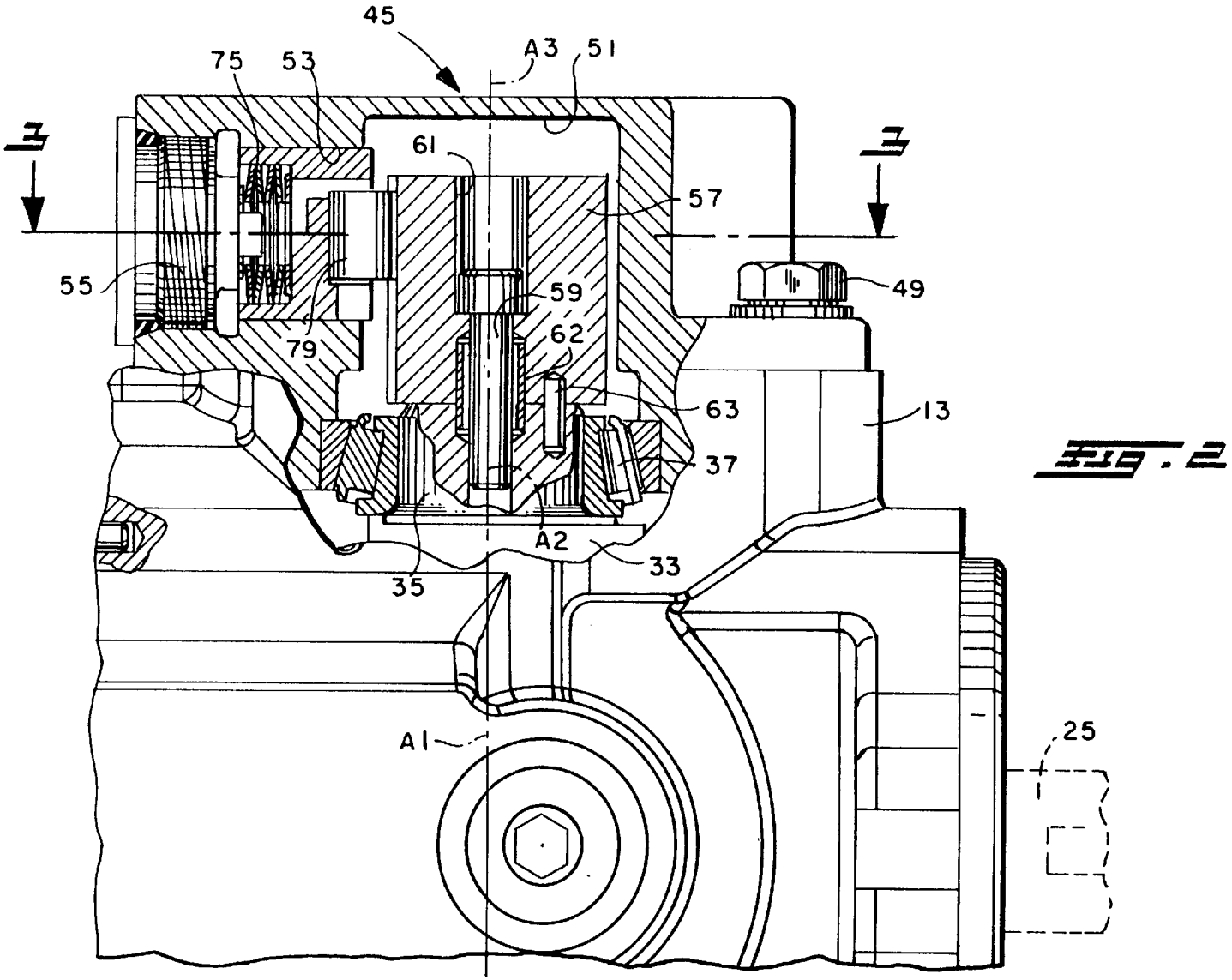
FIG. 2 is a top plan view, with portions broken away, of the pump shown in FIG. 1.
Figure 2A:
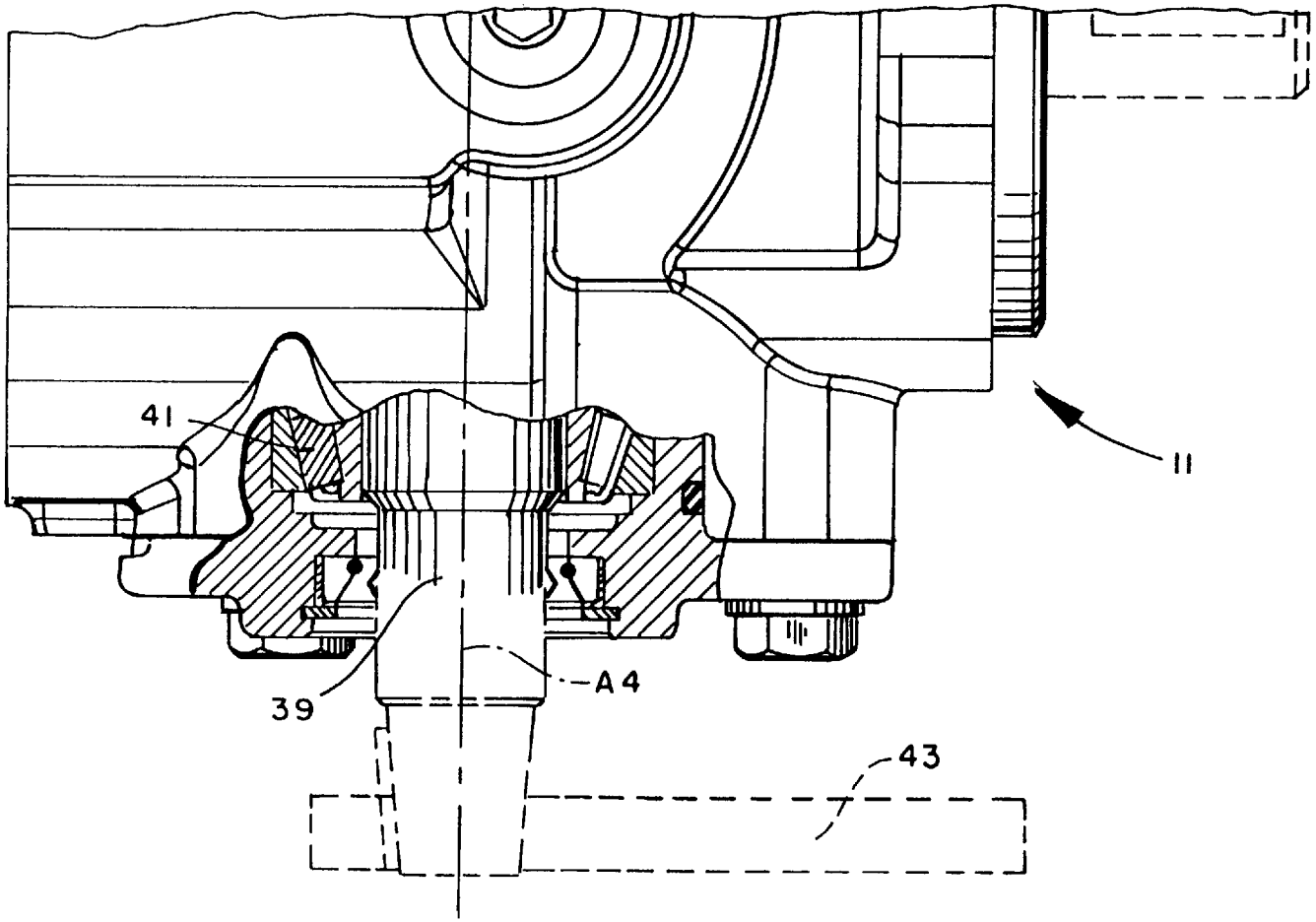
FIG. 2A is a top plan view, partly in schematic, with portions broken away, of the other half of the pump shown in FIG. 2.

Referring now primarily to FIGS. 2 and 2A, it may be seen that the swashplate 33 includes a trunnion member 35 defining an axis of rotation A2, which is preferably coincident with the axis A1 of the swashplate 33. The trunnion member 35 is rotatably supported, relative to the pump housing 13, by a suitable bearing set 37. Similarly, and as shown in FIG. 2A, the swashplate 33 also includes an input trunnion 39 defining an axis of rotation A4, the input trunnion 39 also being rotatably supported relative to the pump housing 13 by means of a suitable bearing set 41. Attached to the input trunnion 39 is a manual input lever, shown somewhat schematically at 43, by means of which the vehicle operator is able to vary the tilt angle of the swashplate 33, and therefore, the fluid displacement of the pump 11.

Figure 3:
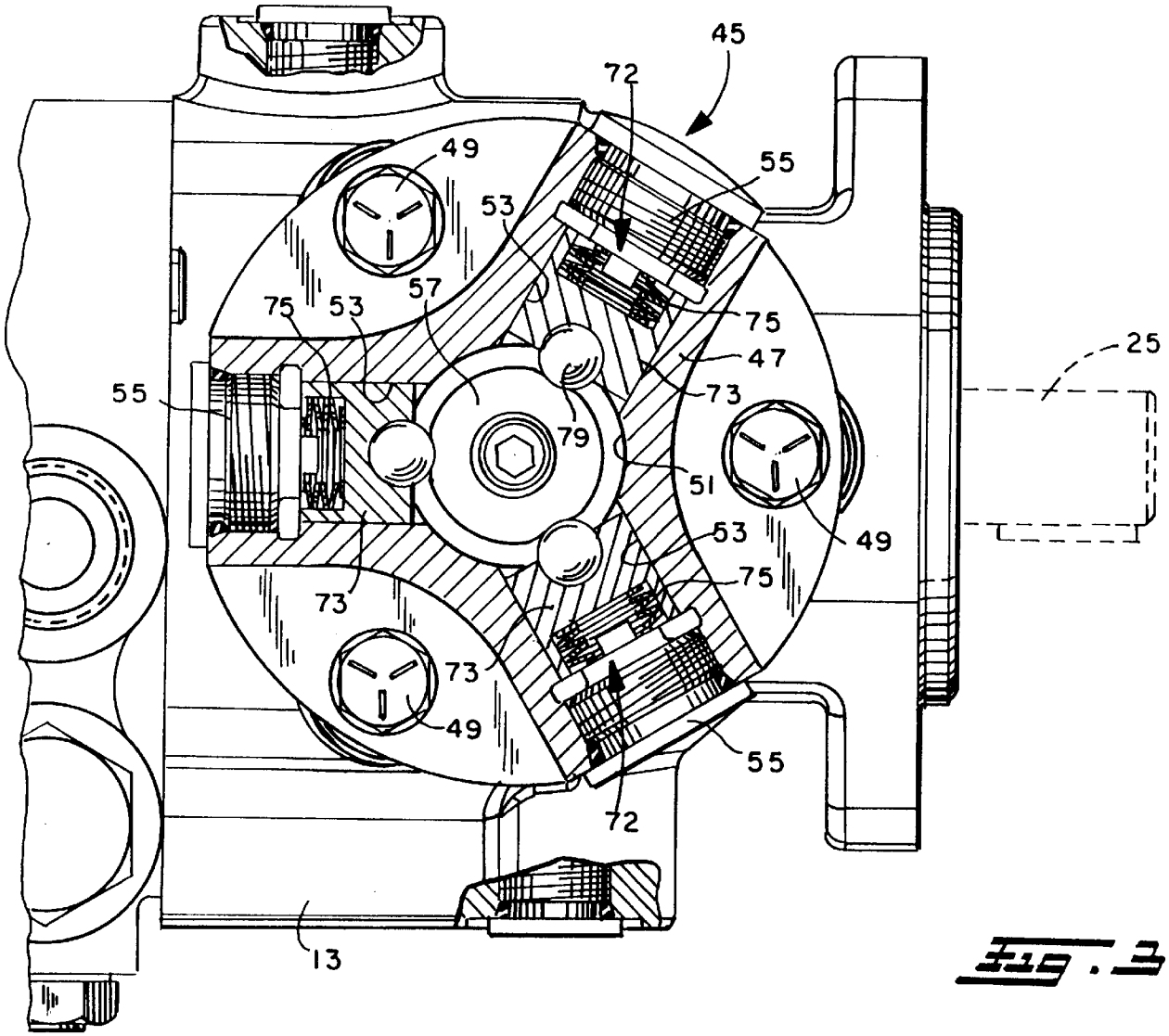
FIG. 3 is an axial cross-section, on a plane parallel to the plane of FIG. 1, and taken on line 3—3 of FIG. 2, and on the same scale as FIG. 2.

Referring now primarily to FIGS. 2 and 3, the neutral centering device of the present invention, generally designated 45, will be described in detail. The device 45 comprises a housing member 47 which is fixed to the pump housing 13, in the subject embodiment, by three bolts 49. The housing 47 defines a central open chamber 51, and three equally spaced follower bores 53, each of the bores 53 opening into the central chamber 51. Each of the bores 53 includes, toward its radially outer extent, a set of internal threads, and in threaded engagement therewith is a plug member 55, the function of which will be described subsequently. It is one important aspect of the present invention that the housing 47 serves as an enclosure for the neutral centering mechanism to be described, and as a container for fluid within the pump case. As a result, the mechanism is enclosed and protected from damage, and is well lubricated to reduce friction, contamination, corrosion and wear.

Disposed within the central chamber 51 is a cam member 57, which is generally cylindrical, and which is attached to the end of the trunnion member 35 by means of a bolt 59, the head of which is received within a central bore 61 defined by the cam member 57. Disposed radially between the bolt 59 and the cam member 57 is a hollow dowel 62, which keeps the cam member 57 concentric to the trunnion member 35. The cam member 57 defines an axis of rotation A3, which is preferably coincident with the axes A1 and A2. In order to achieve the desired rotational orientation of the trunnion member 35 and the cam member 57, a pin 63 is provided, its opposite ends being disposed within a pair of close-fitting bores defined by the trunnion member and the cam member.

As is well known to those skilled in the art, it is typically desirable for the axial piston pump 11 to be operable "over-center," which means that the swashplate 33 may be displaced in either direction from its neutral position, to reverse the direction of flow, as the input shaft 25 continues to rotate in the same direction. Thus, the cam member 57 defines three cam surfaces 65, and as may best be seen in FIG. 4, each cam surface 65 includes a central, minimum (zero) displacement portion 67 and "forward" and "reverse" maximum displacement portions 69 and 71, respectively. However, the present invention is not limited to a cam member in which the cam surface 65 has both forward and reverse maximum displacement portions, but instead, includes neutral centering mechanisms for pumps which are not required to operate over-center, in which case there would be only a single maximum displacement portion on the cam surface.

Figure 4:
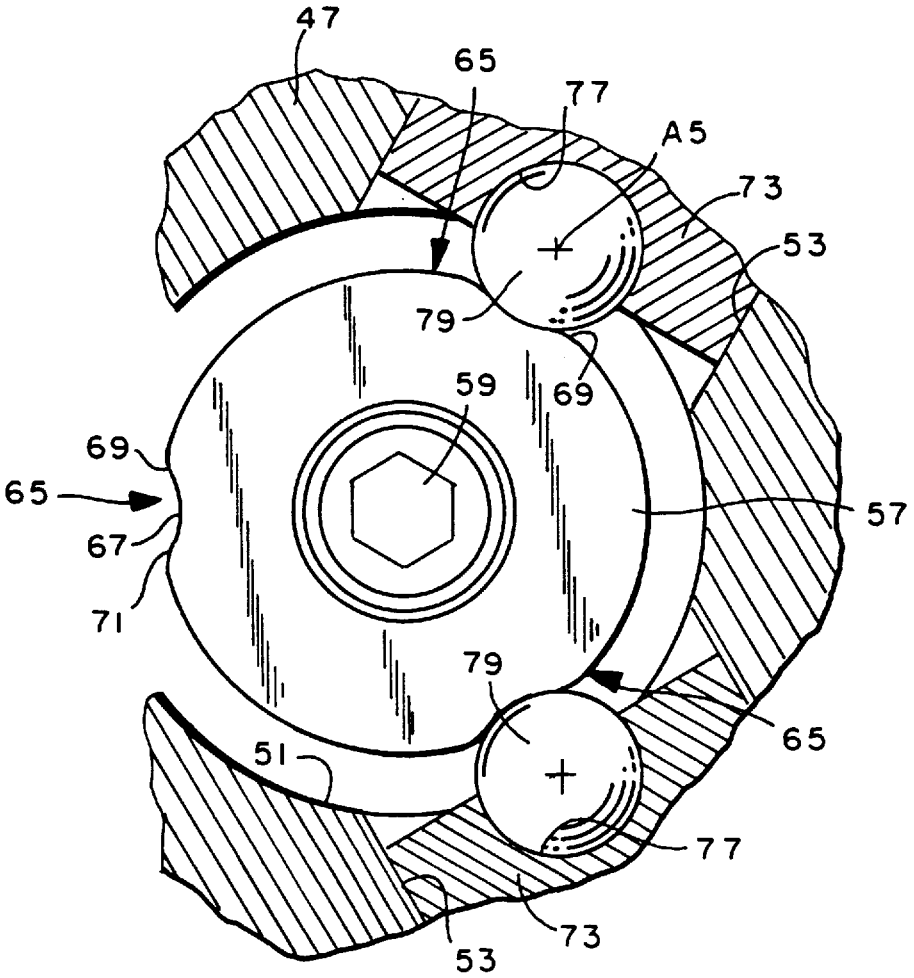
FIG. 4 is an enlarged, fragmentary axial cross-section, similar to FIG. 3, illustrating the cam surface of the present invention in greater detail.

Referring now primarily to FIGS. 3 and 4, it may be seen that within each of the follower bores 53 is disposed a cam follower assembly, generally designated 72, each assembly 72 including a cam follower holder 73. Each of the cam follower holders 73 is biased toward its minimum displacement position shown in FIG. 3 by means of a set of Belleville washers 75, one end of which is seated against a bore defined by the holder 73, and the other end of which is seated against the other surface of the plug member 55. It should be understood that the invention is not limited to the use of Belleville washers, although such is preferred for reasons of packaging, but various other forms of biasing means could be utilized. Furthermore, if Belleville washers are used as shown, there may be a different number used, or they may be used in parallel, rather than in series as shown.

Each cam follower holder 73 defines a generally semi-cylindrical recess 77 (see FIG. 4), and disposed in each recess 77 is a cylindrical roller member 79, which is rotatable about an axis of rotation A5, and which comprises a cam follower element, disposed in contact with its respective cam surface 65. Preferably, a fluid pressure vent passage is formed in each of the follower holders 73, to equalize fluid pressure on the opposite ends of the holders 73.

With the swashplate 33 in its neutral position (corresponding to FIGS. 3 and 4), each roller member 79 is in engagement with its respective minimum displacement portion 67 of the cam surface 65. As the swashplate 33 is manually displaced from the neutral position, for example, toward a forward displacement position, the cam member 57 is rotated counterclockwise in FIGS. 3 and 4, such that each roller member 79 is in engagement with its respective forward maximum displacement portion 69 of the cam surface 65. As may best be seen in FIG. 4, the rotation of the cam member 57 described above will cause each of the roller members 79, as well as their respective cam follower holders 73, to move radially outward in opposition to the force of the Belleville washers 75. In accordance with one important aspect of the invention, the cam surface 65 is configured such that, when the operator again returns the manual input lever 43 to a position somewhere near its neutral location, the force of the Belleville washers 75 acting on the roller members 79 will, in turn, exert a torsional force of the cam member 57, rotating it to its exact neutral (zero displacement) position represented in FIG. 3.

Although not an essential feature of the invention, it is preferred that the cam member 57 have three of the cam surfaces 65, and that there be three of the cam follower assemblies 72. Furthermore, it is preferred that the three cam arrangements be equally spaced, circumferentially, such that the radial forces exerted on the cam member 57 are substantially balanced and that there be no substantial load imposed by the neutral centering device 45 which is, in turn, imposed on the trunnion bearing set 37.

In a number of the prior art neutral centering devices, assembly was made more difficult by the need to preload a biasing spring which, in many cases, required some sort of fixture or other holding device. It is one important aspect of the present invention that the assembly of the neutral centering device 45 is extremely simple. Once the swashplate 33 is in place within the pump housing 13, and the trunnion member 35 is supported within its bearing set 37, the cam member 57 is first bolted to the end of the trunnion member 35 by means of the bolt 59 in the manner described previously.

Next, the housing member 47 is bolted in place by means of the bolts 49. Preferably, the holes in the pump housing 13 for the bolts 49 are made enlarged or slotted, to allow rotation of the housing 47, relative to the pump housing 13. This is the alignment of the neutral position of the centering device 45 relative to the actual neutral position of the swashplate 33. Then, with the swashplate 33 and the cam member 57 in their neutral position, each of the bolts 49 is tightened, then each of the cam follower assemblies 72 is inserted within its respective follower bore 53. Typically, an appropriate grease would be used to hold each roller member 79 within its recess 77 during the assembly step. As each follower holder 73 and roller member 79 is put in its proper position, each plug member 55 is threaded into its respective bore 53 until the rollers 79 each engage their respective minimum displacement portions 67, as shown in FIGS. 3 and 4. Typically, the three plug members 55 would be threaded in simultaneously, or each would be threaded several turns, then the next one would be threaded several turns, to avoid imposing a substantial sideload on the cam member 57 during the assembly operation.

Alternatively, as part of the assembly process, shims may be placed between the Belleville washers 75 and the plug members 55, thus generating a preload force on the holders 73 and follower elements 79. It is another important aspect of the present invention that assembly of the device 45 may be accomplished without the need for any special jigs or fixtures, even if a substantial preload will be applied to the cam member 57, through the holders 73 and follower elements 79.

Although the profile of the cam surface 65 has been described only generally, and as having a minimum displacement portion 67 and a pair of maximum displacement portions 69 and 71, those skilled in the art will recognize that the present invention offers the pump designer various options. For example, the cam surface 65 can be profiled such that there is a substantially constant return torque being exerted over the entire range of rotation of the cam member 57. If a return torque of 50 inch-pounds is desired, the cam surface 65 can be selected such that there is a return torque of 50 inch-pounds exerted on the cam member 57 even as it is displaced from its absolute neutral position The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A variable displacement pump assembly of the type comprising a pump housing defining a pumping chamber, a rotating group disposed in said pumping chamber, and a tiltable swashplate operably associated with said rotating group to vary the fluid displacement thereof; said swashplate defining a tilt axis and including a trunnion member having its axis of rotation coincident with said tilt axis, said trunnion member being rotatably supported relative to said pump housing; and a neutral centering mechanism operably associated with said pump housing and with said swashplate; characterized by:

(a) said neutral centering mechanism comprising a cam member having an axis of rotation, and being fixed to rotate with said trunnion member; said axis of rotation of said cam member being coincident with said axis of rotation of said trunnion member;

(b) said cam member defining a cam surface oriented generally parallel to said axis of rotation of said cam member, said cam surface including a minimum displacement portion and a maximum displacement portion;

(c) said neutral centering mechanism further including a cam follower assembly fixed relative to said pump housing, and including a cam follower element, and means biasing said cam follower element into engagement with said cam surface, whereby, when said cam follower element is in engagement with said maximum displacement portion of said cam surface, said biasing means and said cam follower element bias said cam member toward a neutral position in which said cam follower element is in engagement with said minimum displacement portion of said cam surface.

2. A variable displacement pump assembly as claimed in claim 1, characterized by said rotating group comprising a rotatable cylinder barrel defining a plurality of cylinders and a piston reciprocably disposed in each of said cylinders.

3. A variable displacement pump assembly as claimed in claim 1, characterized by said tiltable swashplate further including an input trunnion having its axis of rotation coincident with said tilt axis, said input trunnion being rotatably supported relative to said pump housing; and further comprising a manual input member operably associated with said input trunnion to translate movement of said input member into tilting movement of said swashplate.

4. A variable displacement pump assembly as claimed in claim 3, characterized by said trunnion member and said input trunnion being disposed on opposite transverse sides of said swashplate.

5. A variable displacement pump assembly as claimed in claim 1, characterized by said cam member being generally cylindrical and defining a plurality N of cam surfaces, each being oriented generally parallel to said axis of rotation of said cam member, and each including a minimum displacement portion and a maximum displacement portion.

6. A variable displacement pump assembly as claimed in claim 5, characterized by said neutral centering mechanism comprising a plurality N of cam follower assemblies, each being fixed relative to said pump housing, and each including a cam follower element, and means biasing its respective cam follower element into engagement with its respective cam surface.

7. A variable displacement pump assembly as claimed in claim 6, characterized by N equals three, and said neutral centering mechanism includes a housing member defining three equally spaced follower bores, a cam follower assembly being disposed in each follower bore, whereby the forces exerted on said cam member in a direction perpendicular to said axis of rotation of said cam member are substantially balanced.

8. A variable displacement pump assembly as claimed in claim 1, characterized by said cam follower element comprises a cylindrical roller member having an axis of rotation substantially parallel to said cam surface; and said cam follower assembly further comprises a cam follower holder defining a generally semi-cylindrical recess adapted to receive and support said cylindrical roller member.

9. A variable displacement pump assembly as claimed in claim 8, characterized by said biasing means comprises a plurality of Belleville washers including one seated relative to a housing member and one seated against said cam follower holder.

* * * * *